United States Patent [19]

VanLierop

[11] Patent Number: 4,724,930

[45] Date of Patent: Feb. 16, 1988

[54] HYDRAULIC LIFT

[75] Inventor: John G. M. VanLierop, Mississauga, Canada

[73] Assignee: 554072 Ontario Inc., Mississauga, Canada

[21] Appl. No.: 704,791

[22] Filed: Feb. 25, 1985

[51] Int. Cl.[4] ..... B66F 7/08

[52] U.S. Cl. ..... 187/8.43; 187/8.5; 187/8.71; 187/8.77; 254/89 H; 254/93 L

[58] Field of Search ..... 187/8.41, 8.43, 8.5, 187/8.71, 8.72, 8.77, 15, 18, 17; 254/89 R, 89 H, 93 R, 93 L, 122; 91/532

[56] References Cited

U.S. PATENT DOCUMENTS

| | | | |
|---|---|---|---|
| 781,872 | 2/1905 | Crane | 187/8.5 X |
| 3,289,868 | 12/1966 | Miller et al. | 254/89 H X |
| 3,494,259 | 2/1970 | Sumida | 91/532 X |
| 3,628,771 | 12/1971 | Egeland et al. | 187/18 X |
| 3,760,688 | 9/1973 | Dummer | 91/532 X |
| 4,157,743 | 6/1979 | Masuda et al. | 187/18 X |
| 4,212,374 | 7/1980 | Bubik | 187/8.43 |
| 4,347,916 | 9/1982 | Schröder | 187/95 |
| 4,447,042 | 5/1984 | Masui | 187/8.43 X |
| 4,491,201 | 1/1985 | Mountz | 187/8.43 X |
| 4,522,285 | 6/1985 | Salmon et al. | 187/22 |

FOREIGN PATENT DOCUMENTS

| | | | |
|---|---|---|---|
| 690682 | 9/1930 | France | 187/8.43 |

OTHER PUBLICATIONS

Wheeltronic, Inc., *Space Saver 9000*, Dec., 1982.

*Primary Examiner*—H. Grant Skaggs
*Assistant Examiner*—Nils Pedersen
*Attorney, Agent, or Firm*—Rogers, Bereskin & Parr

[57] ABSTRACT

A lifting device, for vehicles, has two support platforms. Scissor mechanisms connect these platforms, to bases, and are actuated by hydraulic piston and cylinder assemblies. A combiner and divider valve supplies fluid to the two hydraulic cylinders. A single cross brace can be provided between the two support platforms. This ensures the two platforms operate uniformly, even for an uneven load distribution, while giving a clear working space.

23 Claims, 11 Drawing Figures

HYDRAULIC LIFT

This invention relates to a hoist or lift, for lifting cars and other vehicles, to enable a variety of maintenance work to be carried out.

At the present time, there is available a wide variety of devices for lifting vehicles. Generally, these devices can be split into two categories. In one category, a vehicle is lifted by its wheel, whilst in a second category, the vehicle is supported by its chassis or bodywork, with its wheels hanging freely.

The first category of lifting devices is necessary for carrying out alignment work. Alignment involves adjusting the steering mechanism of a vehicle, to ensure that the wheels are properly aligned. It cannot be carried out with the wheels hanging freely. It has to be carried out with the suspension loaded to its usual working position. To this end, so-called alignement racks are provided. These include rotatable turnplates on which the front or steering wheels of the vehicle are located. Then, without moving the vehicle, the steering wheels can be readily turned, to adjust the alignment etc.. Usually, the vehicle is lifted by the alignment rack, to give free access to the steering mechanism underneath the vehicle. However, such alignment racks are unsuited for many other types of work. If parts of the suspension mechanism needs to be replaced, or if the brakes of the vehicle require work, then it is necessary to support the vehicle, with the wheels and suspension hanging freely. Such work cannot be carried out on conventional alignment racks.

The second category of lifting devices are used for carrying out a variety of maintenance work on vehicles. Many current designs include two or four posts above the ground. In these posts, a variety of somewhat complex mechanisms including, for example, hydraulic cylinders and chains are provided. The mechanism is connected to a platform for lifting a vehicle. In use, a vehicle is positioned above the platform. The platform includes movable supports, which are located beneath the support points of the chassis of the vehicle etc.. Then, the mechanisms in the posts can be used to lift the platform and vehicle up. This then lifts the vehicle, with the wheels hanging freely, so one can readily work on the brake system, etc.. However, such a lifting device has a number of disadvantages. It does not enable alignment work to be carried out, as the steering wheels are hanging freely. Also, whilst such a lifting mechanism provides free access underneath a vehicle, the provision of posts requires a lot of space. The mechanisms included often require a lot of maintenance.

It is desirable that a lifting device or hoist for a vehicle should enable all types of work on the vehicle to be carried out. Further, the device should not obstruct the area underneath the vehicle, so as to provide free access. The device should occupy as little space as possible and require minimum maintanance. Also, preferably the device should not require a pit to be dug or other expensive installation work.

Attempts have been made to design lifting devices, which can function both as ordinary hoists and alignment racks. However, known proposals are complex and expensive.

One known proposal is marketed under the name Flexi-Bay by Hernicke Engineering. It requires one cylinder installed in the ground, and two posts above the ground. The main cylinder lifts up a platform onto which the car is driven. Consequently, this lifts the car by its wheels, which enables alignment work to be carried out. When the weight is required to be taken off the wheels, then the car, or other vehicle, is supported by the two above-ground posts, whilst the main other in-ground cylinder is dropped. It will be appreciated that this effectively requires two lifting mechanisms, both capable of taking the full weight of the vehicle. This results in unnecessary duplication, complexity and cost.

In accordance with the present invention, there is provided: a lifting device for a vehicle, the lifting device comprising: first and second scissor units, each of which includes a base member, a support platform and a pair of levers which are pivotally interconnected adjacent their mid-points, one of which levers is pivotally connected at one end to the base member, and the other of which levers is pivotally attached at one end to the respective support platform, with the other ends of the levers being arranged for rotational and translational movement relative to the respective base member and support platform; for each scissor unit, a respective hydraulic piston and cylinder assembly pivotally attached to the levers of the respective scissor unit, for actuation thereof; a combiner and divider valve means for ensuring that the flows of hydraulic fluid to, or from, the hydraulic cylinders are substantially equal, irrespective of any pressure difference between the hydraulic piston and cylinder assemblies, said means including only an inlet for a supply of pressurized hydraulic fluid, and two outlets connected respectively to the two piston and cylinder assemblies and not including any connection to any other component of the lifting device and only a single cross brace connected between the two support platforms adjacent one end thereof, to assist in maintaining the support platforms level with one anothers.

In this specification and claims, the valve assembly is of the type that is subject only to the fluid which it controls and is not subject to any other fluid input or other type of input, and hence is passive.

Preferably, the combiner and divider valve is disposed generally equidistant between the two scissor mechanisms, and is connected to the two hydraulic cylinders by piping of equal length. This helps ensure that the two flows of hydraulic fluid are substantially equal. Further, preferably the cross-member is provided adjacent rear ends of the two support platforms.

Preferably, the lifting device also includes a jack, which includes an air operated scissor mechanism, and is mounted for sliding movement between the two support platforms. The jack enables the one end of a vehicle to be lifted, so that the front or rear wheels are clear of the support platform.

The lifting device can include one or two jacks, as required. If it is desired to lift all four wheels of a vehicle clear of the device then it is necessary to provide two jacks.

In comparison with known lifting devices, the lifting device of the present invention is compact. It requires little space, and in particular minimizes the installation work required. There is no need to dig a pit. The device is simply located on the floor of a workshop, together with a unit for delivering hydraulic fluid at the required pressure. Where one has a number of lifting devices, a single, central supply of pressurized hydraulic fluid can be provided.

The device of the present invention can also have the advantage of being relatively easy to assemble. As each cylinder is connected directly to the fluid source, air will automatically be bled from the system, after a few cycles. There is no need to carefully bleed the hydraulic circuit. This enables the device to be assembled by personnel who may not be skilled in hydraulics.

The lifting device or hoist of the present invention thus enables a wide variety of jobs to be carried out on a vehicle. For alignment work, turnplates can be provided at the front end of each support platform. Then, it is a simple matter to drive a vehicle onto the device, and lift it to the necessary height, for carrying out the alignment. For work to the brakes, or suspension, which required removal of the wheels, the jack can be used to lift the vehicle above the support platforms, to permit removal of wheels etc. As the device does not require any external posts, it can be installed in a narrow space, and can lead to substantial space savings, as compared to conventional hoists and the like.

For a better understanding of the present invention, and to show more clearly how it may be carried into effect, reference will now be made, by way of example, to the accompanying drawings, which show an embodiment of the present invention, and in which.

Figure 1:
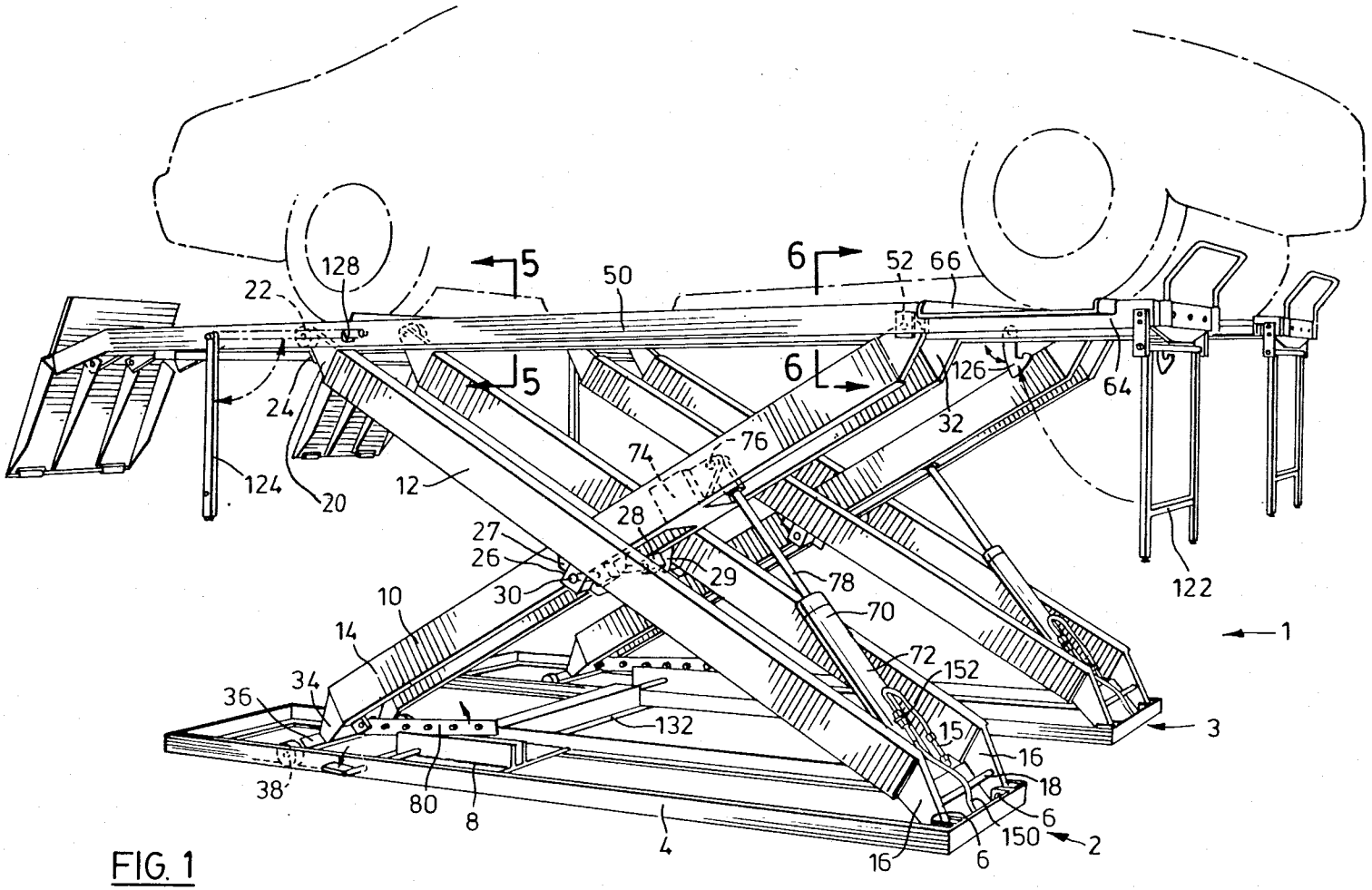
FIG. 1 shows a perspective view of a lifting device in accordance with the present invention.

With reference to FIG. 1, the whole lifting device is generally denoted by the reference 1. The lifting device 1 includes two separate scissor units denoted by the references 2,3. The two separate scissor units 2,3 are generally identical, and are described with reference to the first scissor unit 2.

The scissor unit 2 includes a base 4, which is generally rectangular, and formed from angle section steel. In use, the base 4 is secured to the floor of a workshop. The base 4 includes two pivots 6 at its front end. Each pivot 6 comprises a pair of plates and a short shaft extending between them. At its rear end, the base 4 includes a ratchet mechanism generally noted by the reference 8, and described in detail below.

Above the base 4, there is a scissor mechanism, denoted by the reference 10. The scissor mechanism 10 includes a pair of first levers 12, and a pair of second levers 14. The levers 12,14 are formed primarily from hollow, rectangular section steel, with appropriate end fittings. The first levers 12 are provided at their lower ends with pivots 16, formed from triangular plates. These pivots 16 are connected to the pivots 6, and a cross-member 18 is provided between them. At the upper ends of the first levers 12, there are corresponding extensions, in the form of triangular plates 20. To these triangular plates 20, there are rotatably attached two rollers 22. A cross piece 24 is also provided at the upper end of the first levers 12.

The second levers 14 are provided inside the first levers 12. Further, the levers 12,14 are pivotally attached adjacent their midpoints. This is achieved by blocks 26 welded to the first levers 12 and blocks 28 welded to the second levers 14. The blocks 26,28 are braced by braces 27,29 respectively. The blocks 26,28 have horizontal openings, and a common shaft 30 runs through the blocks 26,28 to form the pivot connection.

Figure 2:
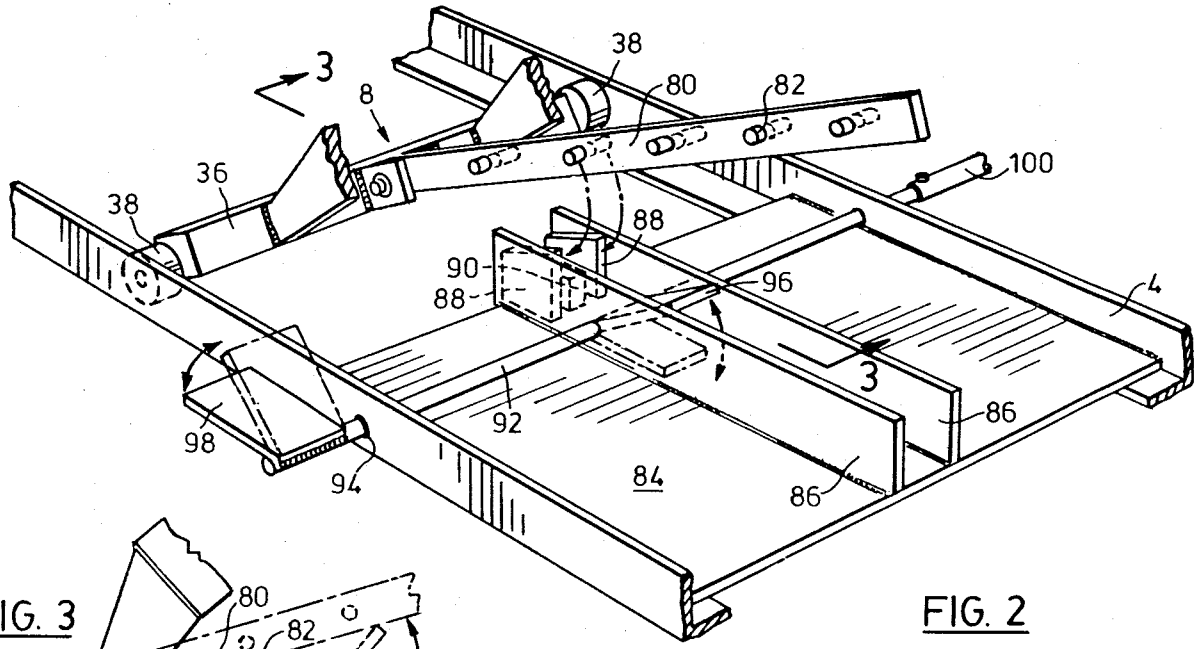
FIG. 2 shows a perspective view of a ratchet mechanism forming part of the lifting device.

The second levers 14 are generally similar to the first levers 12, except that the second levers 14 are pivotally attached to the support platform 50. At their upper ends, the second levers 12 include pivots formed by triangular plates 32. The support platform 50 includes corresponding pivots 52, similar to the pivots 6, which engage the triangular pivot plates 32. At their lower ends, the second levers 14 include further triangular plates 34 attached to a cross-member 36. Rollers 38 are rotatably mounted at the ends of the cross-member 36. The rollers 38 are arranged to travel along flanges of the members forming the base 4, as most clearly seen in FIG. 2.

Figure 5:
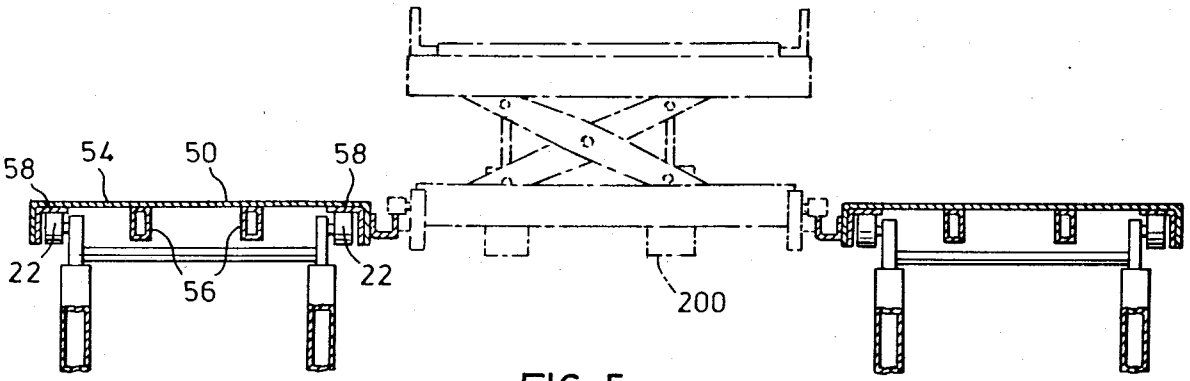
FIG. 5 shows a partial vertical cross-sectional through the lifting device.
Figure 4:
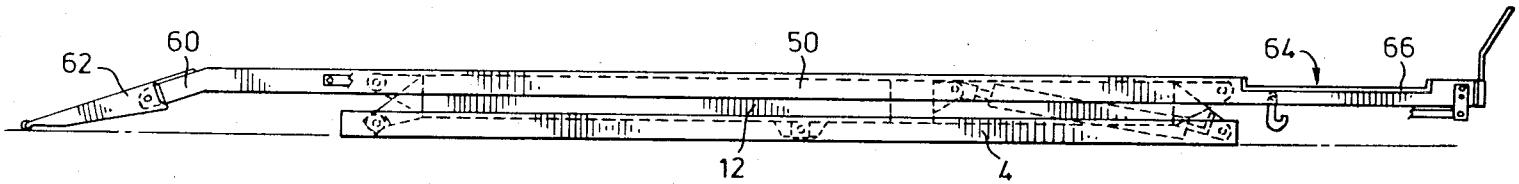
FIG. 4 shows a side view of the lifting device when collapsed.

Turning to the construction of the support platform 50, FIG. 5 shows a section through the two support platforms 50. Each support platform 50 includes a top member 54, formed from sheet steel with downturned side edges. The top member 54 is reinforced below by two elongate members 56 of hollow rectangular section. Along either side, the top member 54 is reinforced by two angle section members 58. As shown in FIG. 5, the rollers 22 are arranged to roll along flanges of the elongate angle section members 58. With reference to FIG. 4, it can be seen that at the rear of each support platform 50, the platform 50 is turned down as indicated at 60. This is to provide a smoother approach, and is particularly intended for cars with front spoilers which might otherwise catch on the support platforms. Also, approach ramps 62 are pivotally attached to the ends of the support platforms 50, to provide a transistion from the floor to the support platforms 50.

Figure 6:
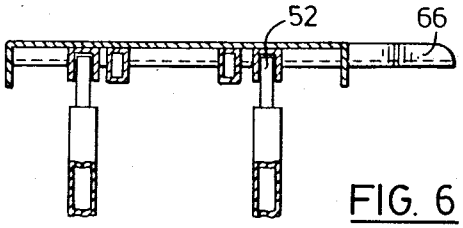
FIG. 6 shows a vertical section through one support platform, showing a turnplate mechanism.

With reference to FIGS. 4 and 6, at the front of each support platform 50, there is a recessed section 64, formed by a shallow U-shaped member extending 66, which extends across the support platform 50 and projects to the outer side of the platform 50. This recessed section 64 is for alignment equipment, as discussed in detail below.

To actuate the scissor unit 2, an hydraulic cylinder and piston assembly 70 is provided. This includes a cylinder 72 pivotally attached at its lower end to the cross-member 18. Between the two second levers 14, there is a rigid cross-member 74 including a pivot 76. Again, the pivot 76 is formed from two projecting plates with a short shaft between. The piston 78 of the assembly 70 includes an end portion pivotally mounted on the pivot 76.

As mentioned above, a ratchet mechanism 8 is provided for holding the scissor unit 2 in a desired position. This ratchet mechanism 8 comprises an elongated rectangular plate 80, which is pivotally attached at one end to the cross-member 36. As shown most clearly in FIG. 2, the elongate plate 80 includes a series of short cylindrical portions 82, which project out on either side from the plate 80. The plate 84 is welded to the side members of the base 4. Two further rectangular plates 86 are welded to this bottom plate 84 and extend vertically to define a channel. Within the channel, there are two plate sections 88, and a small block 90. Also, a rod 92 extends through openings 94 in the base 4. Rectangular plates 96,98 are welded to the rod 92. The rectangular plate 96 forms a lifting plate, whilst the rectangular plate 98 forms an operating plate or pedal. The other base 4 is provided with a rod similar to the rod 92 and is connected to the rod 92 by a tube 100. This enables both rods to be operated by the single pedal or plate 98.

Figure 3:
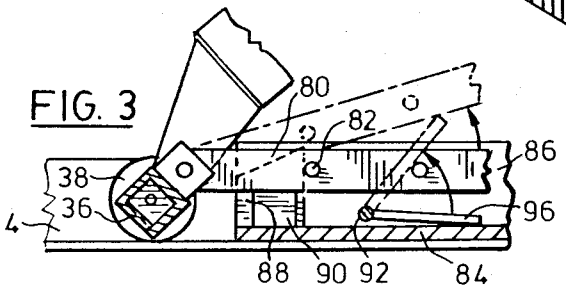
FIG. 3 shows a side view of the ratchet mechanism of FIG. 2.

With reference to FIG. 3, in use, the elongated plate 80 is simply dropped into the channel between the plates 86,88. As the support platform 50 of each scissor unit 2,3 is raised, the corresponding cross-member 36 travels towards the bottom plate 84. As this occurs, the cylindrical shafts 82 can ride up over the plate sections 88, due to their inclined top surfaces. When the lifting operation is finished, the ratchet device 8 will secure the respective support platform 50 in position. If the support platform 50 starts to fall for any reason, e.g. due to an hydraulic failure, then the portions 82 will come up against the plate section 88, to prevent further travel of the cross-member 36. This thus provides a simple and reliable safety mechanism. It has the further advantage that it can be readily and visually checked by an operator. To release the ratchet mechanism 8, the operator simply stands on the plate 98, this lifts the plate 96, and thus lifts the elongated rectangular plate 80 clear of the plate sections 88; this is shown in ghost outline in FIG. 3.

Figure 7:
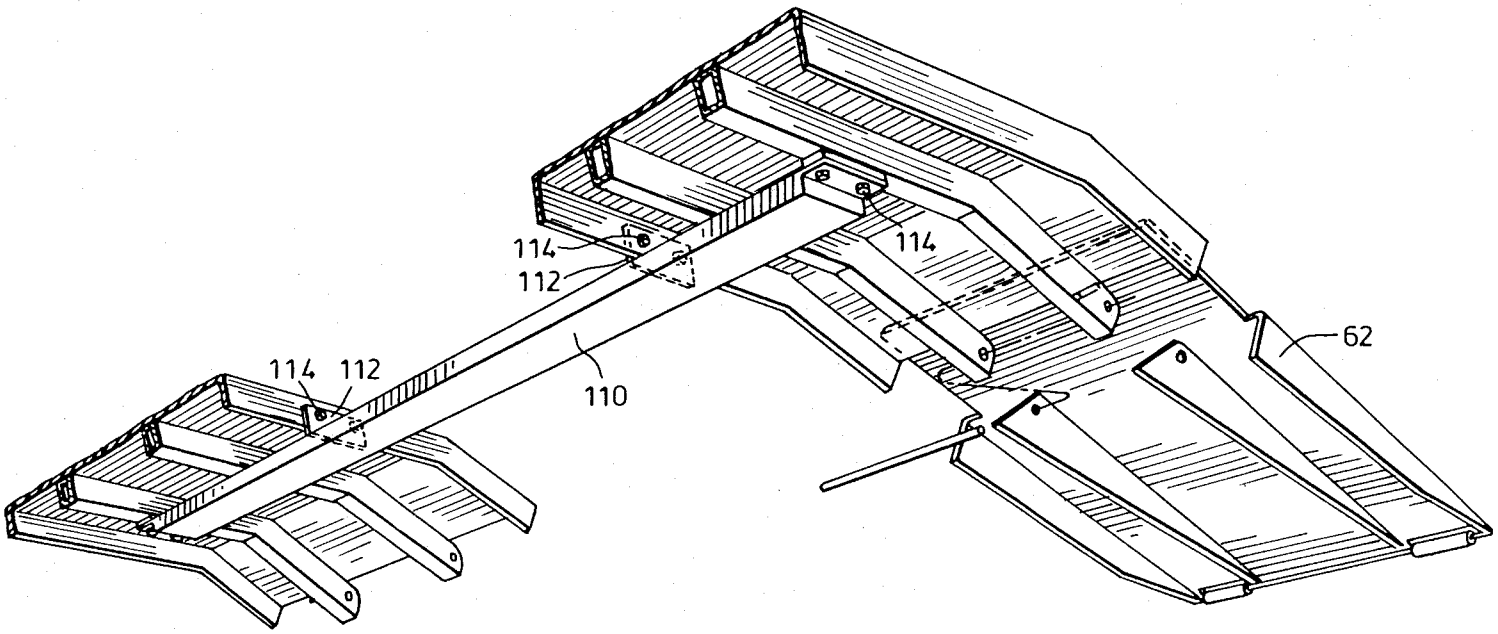
FIG. 7 shows a perspective view of ends of the support platform.

FIG. 7 shows a cross brace 110. This cross brace 110 is a rectangular-section tube, to which attachment flanges 112 are welded. The cross brace 110 and flanges 112 are bolted by bolts 114 to the elongate members 56 and top members 54 of the two support platforms 50. As shown, the cross brace 110 is provided near the back of the lifting device 1. As detailed below, the cross brace 110 assists in keeping the support platforms 50 level, even in the presence of an unbalanced load.

The support platforms 50 are provided with a number of other features, which are best seen in FIG. 1. In known manner, at the front of each support platform 50, there is a stop 120, each of which is formed from circular section steel bar. For alignment work, it is necessary that a vehicle is located at the correct height. For this purpose, each support platform includes a front location frame 122, and a rear location bar 124. These are pivotally mounted, and as indicated can be swung into horizontal positions. For the front location frame 122, there is a hook 126, for holding it underneath the corresponding support platform 50. Similarly, the rear support location bar 124 can be swung up alongside the support platform 50 and held on a bracket 128.

Figure 8:
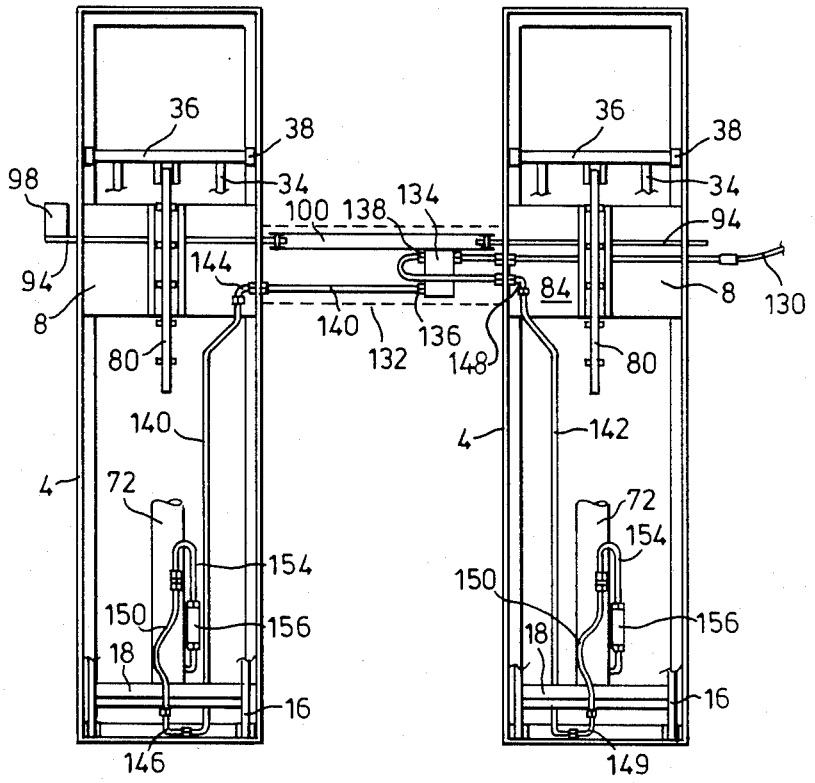
FIG. 8 shows a plan view of part of the lifting device.

Turning to FIGS. 1 and 8, there are shown details of the hydraulic circuit. The lifting device 1 is provided with hydraulic fluid at a suitable pressure, from a known source, which is not shown here. Hydraulic fluid is supplied through a line 130. As shown, this line 130 crosses through the sides of one of the bases 4, adjacent the rod 94. Extending between the two bases 4 is a tophat-shaped member 132. This member 132 covers the tube 100 and part of the supply hose 130. Also under the member 132 there is a combiner and divider valve 134. This valve 134 is located near to the mid or central axis of the lifting device 1. The combiner and divider valve 134 has an inlet connected to the line 130, and two outlets. It is such that it always ensures an equal flow of fluid through the two inlets, irrespective of pressure variations at the two outlets, within certain limits. The two outlets are designated 136, 138. As shown, from the outlet 136, a first branch 140 extends across to the first scissor unit 2. It is connected to a right angle connector 144, and the branch 140 continues to the front of the scissor unit 2. Here it turns through a right angle and then is connected to a further right angle connector 146, secured to the base 4. The other end of the connector 146 is connected to a respective flexible hose 150. This hose 150 extends to a bracket 152 secured to the cylinder 72. A short length of rigid pipe 154 leads to a velocity fuse 156, which in turn is connected to an inlet of the cylinder 72. The flexible hose 150 provides the necessary flexible connection to accomodate movement of the cylinder 72. The second branch 142 turns through 180° on leaving the combiner and divider valve 134. Like the branch 140, it has a right angle connector 148 secured to the base 4. The branch 142 then has two bends of small angle, and continues to the front of the scissor unit 3. Here, it turns through ninety degrees, and is connected to a right angle connector 149. The connector 149 is connected to a respective flexible hose 150 Again this is connected via a respective rigid pipe 154 to a velocity fuse 156.

It has been found that having branches 140, 142 of comparable length and with similar bends is important to ensure equal flow in the branches 140, 142. This is achieved by placing the valve 134 near the central axis of the device.

In use, the device 1 will first be positioned in its lowermost position, as shown in FIG. 4. A vehicle can then be driven onto the support platforms 50, by the approach ramps 62. Note that the turned down sections 60 enable vehicles with low hanging parts, in particular with deep front skirts, to be driven onto the device 1 without catching part of it. With the vehicle on the support platforms 50, the supply of hydraulic fluid is actuated or connected to the hydraulic cylinder and piston assemblies 70. This then lifts the vehicle upwards. Note that the hydraulic cylinder and piston assemblies 70 are so positioned and located, as to permit a relatively large load to be lifted or cracked, for a reasonable hydraulic fluid pressure. In this regard, it is to be noted that in the position of FIG. 4, the cylinder and piston assemblies are at their most disadvantageous position. As the vehicle is lifted, the combiner and divider valve 134 ensures that hydraulic fluid is supplied equally to the two cylinders 72, thereby ensuring the vehicle is lifted uniformly. Also, the cross brace 110 assists in bracing the two support platforms 50 and maintaining them level and horizontal. These two features together ensure that the support platforms 50 cannot become misaligned. By way of example, for a lifting device rated for a 9,000 pound load, the cross brace 110 could be designed, so that, with the valve 134 a load difference of 4,000 pounds between the two support platforms can be accepted.

Once the vehicle has been lifted to the required height, the supply of hydraulic fluid is turned off. If desired, the vehicle can be lowered slightly, so as to ensure positive engagement of the ratchet devices 8. The operator then has a clear visual indication that the device is secured, and he can then confidently work underneath the vehicle. Also, the velocity fuses 154 provide an additional safety feature. These fuses 154 are rated for a certain flow rate, for example 2 gallons per minute. If the flow of fluid from one of the cylinders 72 exceeds this value, then the velocity fuse 154 closes off the flow, to lock the respective piston 78 in position. Thus, if a supply line is accidentally reptured, the velocity fuses 154 will close off the cylinders 72, before any significant fluid loss occurs. This also prevents the device 1 accidentially falling or dropping.

Once the required work has been completed on the vehicle, then the device 1 can be lowered. The pedal or plate 98 is pressed down, to release both ratchet devices 8, and a hydraulic control valve operated to permit the cylinders 72 to discharge through the supply line 130 to a reservoir. The discharge rate is low enough, to prevent actuation of the velocity fuses 154. In any event, if the flow rate becomes too high, which would give a correspondingly fast descent for the vehicle, the velocity fuses 154 will close off the flow to lock the device. When lowering a vehicle, the valve 134 also insures that the discharge flows from the two cylinders 72 are equal, irrespective of any load variation.

For carrying out alignment work, a vehicle is lifted to a height slightly above the height set by the front location frames 122, and the rear location bars 124. These front frames 122 and location bars 124 are then lowered, to the position shown in FIG. 1. The lifting device 1 is then lowered slightly, until they just contact the floor. The weight of the vehicle is still principally taken by the support platforms 50. In this position, the lifting device 1 is locked, and any required alignment work can be carried out.

Figure 9:
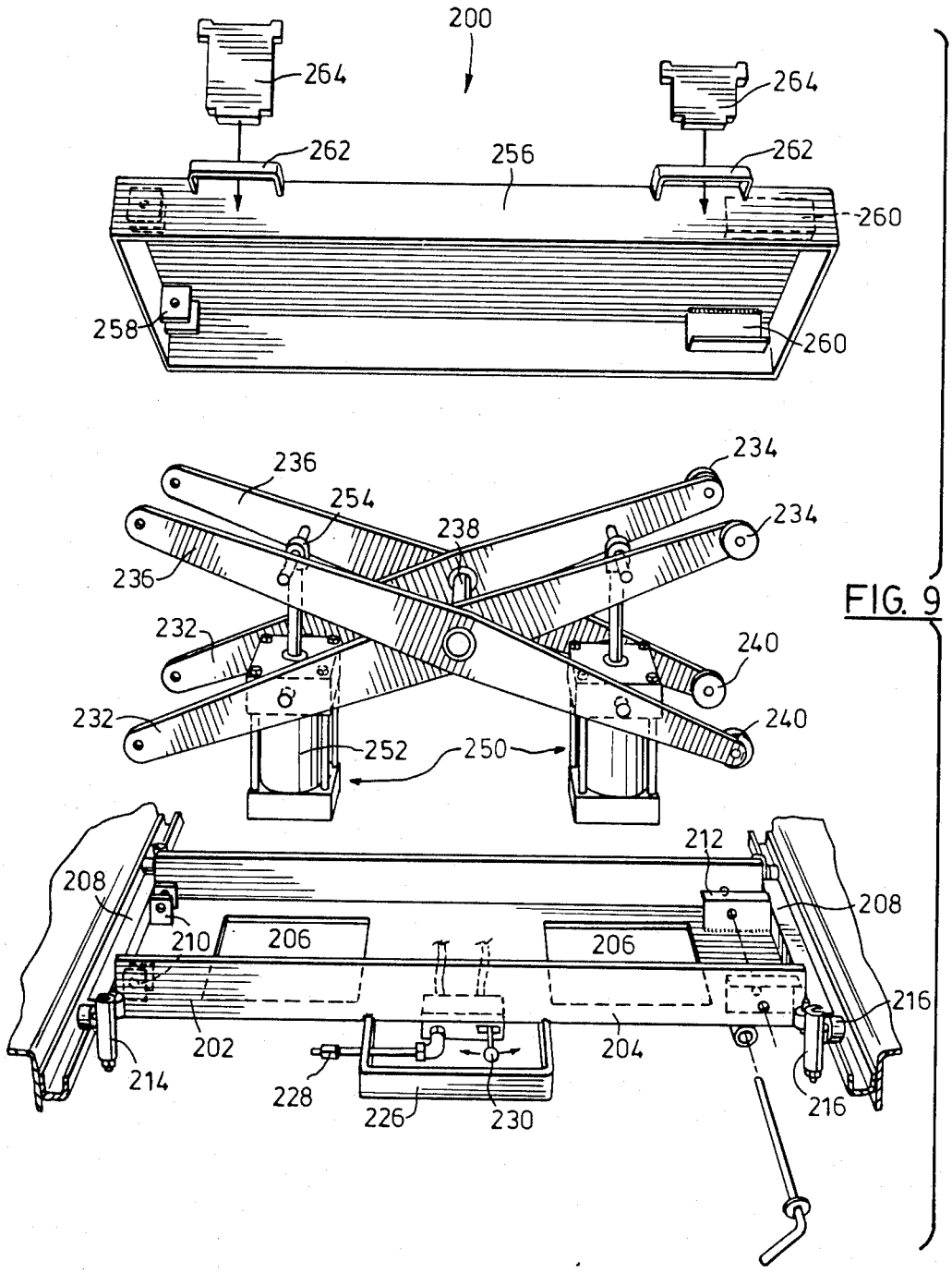
FIG. 9 shows a perspective, exploded view of a jack.
Figure 10:
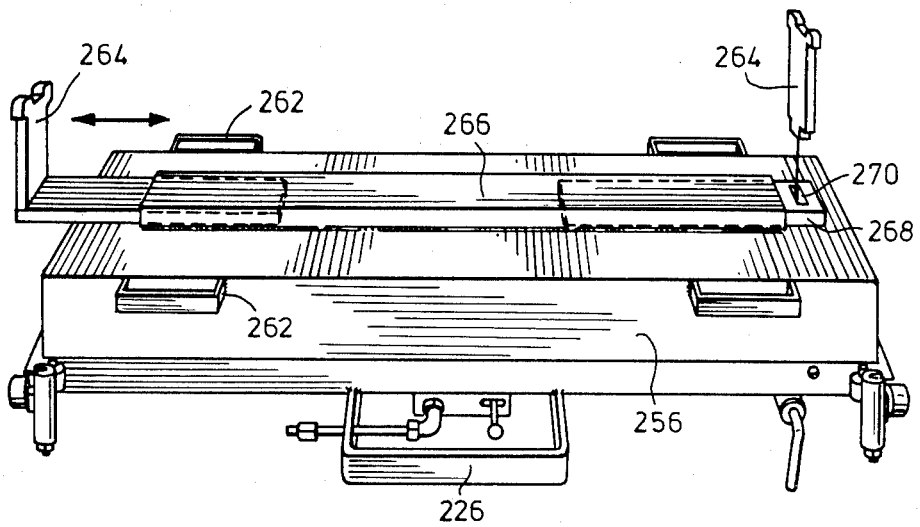
FIG. 10 shows a perspective view, from above, of the jack when collapsed.
Figure 11:
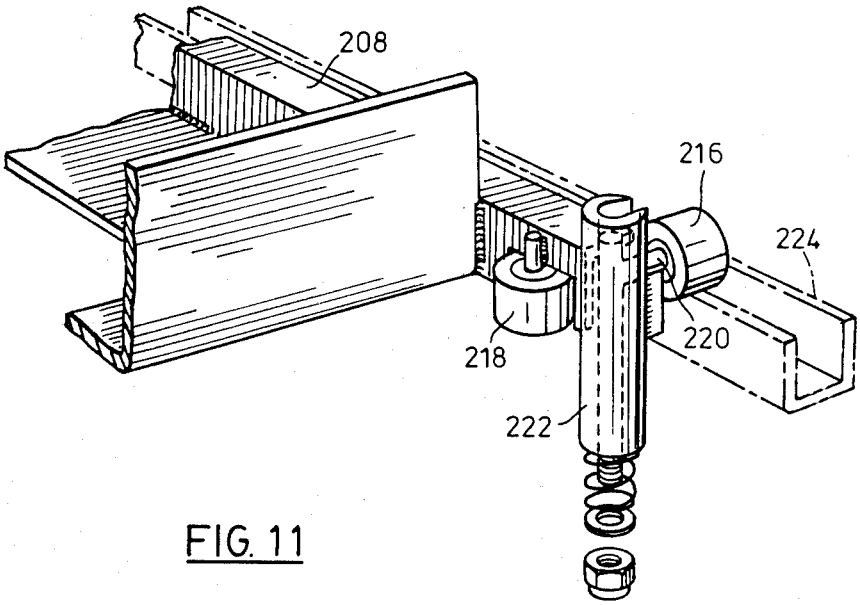
FIG. 11 shows on a larger scale, a perspective view of part of the jack.

Reference will now be made to FIGS. 9, 10 and 11, which show details of a jack, adapted for use with the lifting device of the present invention. This jack is the subject of a separate, copending patent application Ser. No. 704,696, now U.S. Pat. No. 4,652,197 in which the jack is described in detail. Here, only the major features of the jack are described, which are of relevance to the present invention. The jack is denoted by the reference 200.

With reference to FIG. 9, the jack 200 includes a base member 202, which is formed from sheet steel, with turned up sides 204. It includes square openings 206. Along either side, there are angle section members 208. The base member 202 includes brackets 210, for pivots and inverted L-section members 212.

At the corners of the base member 202, there are four corresponding roller assemblies 214. Each roller assembly 214 includes a horizontal roller 216 and a vertical roller 218, the designations horizontal and vertical referring to the axes of the rollers. FIG. 11 shows the roller construction in detail. The vertical roller 218 is rigidly mounted. The horizontal roller 216 is rotatably mounted to a shaft 220, which includes a vertical portion 222. Along the inside of each support platform 50, there is a U-shaped channel member 224, along which the rollers can travel. The portion 222 and hence the roller 216 are biased downwards by a spring, so as to normally maintain the corresponding angle section member 208 clear of the channel member 224. In use, when a sufficient load is applied to the jack 200, the two angle section members 208 are pressed downwards to engage the channel members 224, and hence prevent further movement of the jack 200.

The base member also includes a handle 226. Extending through the handle 226 is a supply line 228 for hydraulic fluid, and operating lever 230.

A first pair of arms 232 are pivotally connected to the brackets 210. The second, upper ends of the arms 232 include rollers 234. A second pair of second arms 236 are connected to the first arms 232 by a common shaft 238, extending through their midpoints. Lower ends of the second arms 236 include rollers 240, which are engaged under the inverted L-section members 212. As detailed below, the upper ends of the second arms 236 are arranged for pivotal connection to a top member of the jack 200.

Two air piston and cylinder assemblies 250 extend vertically between the arms 232,236. Each air piston and cylinder assembly 250, includes a cylinder 252, which is pivotally connected between one pair of arms 232 or 236 and a piston 254 including a free end pivotally connected between the upper pair of arms 236 or 232.

A top member 256 generally corresponds to the base member 202 and is dimensioned so as to enclose it. The top member 256 includes brackets 258, which are pivotally connected to the arms 236. At its other end, the top member 256 includes L-section members 260, which engage the rollers 234.

There are elongate brackets 262 extending out from the sides of the top member 256, for storing supports 264. This enables a variety of supports 264 to be stored, which are adapted to support a number of different vehicles. As shown in FIG. 10, a channel 266 is formed along the top of the top member 256. Extensions 268 are slidably received in this channel 266. At the end of each extension 268, there is an opening 270, into which a support 264 can be fitted. This arrangement enables the supports 264 to be moved laterally.

In use, after a vehicle has been driven onto the lifting device 1 and lifted to a desired height, the jack 200 can be readily manouvered along the length of the device until it is beneath jacking points of the vehicle. In this regard, the roller assemblies 214 ensure that the jack 200 can be readily slid along the channel members 224. In known arrangements, if a jack is not pushed or pulled exactly centrally, then it can twist and jam, rather than travelling freely. In the present case, the provision of the vertical rollers 218 ensures that the jack 200 will always travel freely, even if a force is applied off centre.

Once the jack 200 is in position, the operator chooses the required supports 264, fits these into the extensions 268, and manouvers them under the jacking points of the vehicle. The operating lever 230 is then used to supply compressed air to the cylinders 252. Since both cylinders operate on one scissor unit, there is no need to provide a combiner and divider valve. As soon as the supports 264 contact the vehicle and start to take the vehicle weight, the base 202 is pressed down, so that the angle section members 208 contact the channel members 224. The jack 200 is then secure, and will not move. The vehicle can then be lifted to a desired height above the support platforms 50. Then, as required, work can be carried out on the wheels, suspenion, etc.

In contrast to known jacks which employ a large cylinder at an angle, this jack 200 has two cylinders which operate vertically. Further, the attachment points of the piston and cylinder assemblies 250 are such that the displacement of the pistons 254 is amplified. Thus, one could use two cylinders having 5 and ½ inch travel, which will give 9 and ½ inch travel for the top member 256.

The embodiments of the invention in which an exclusive property or privilege is claimed are defined as follows:

1. A lifting device, for a vehicle, the lifting device comprising: first and second scissor units, each of which includes a base member, a support platform and a pair of levers which are pivotally interconnected adjacent their mid-points, one of which levers is pivotally connected at one end to the base member, and the other of which levers is pivotally attached at one end to the respective support platform, with the other ends of the levers being arranged for rotational and translational movement relative to the respective base member and support platform; for each scissor unit, a respective hydraulic piston and cylinder assembly pivotally attached to a lever of the respective scissor unit, for actuation thereof; a combiner and divider valve means for ensuring that the flows of hydraulic fluid to, or from, the hydraulic cylinders are substantially equal, irrespective of any pressure difference between the hydraulic piston and cylinder assemblies, said means including only an inlet for a supply of pressurized hydraulic fluid, and two outlets connected respectively to the two piston and cylinder assemblies and not including any fluid connection to any other component of the lifting device; and only a single cross brace connected between the two support platforms adjacent one and thereof, to assist in maintaining the support platforms level with one another.

2. A lifting device as claimed in claim 1, wherein the combiner and divider valve means is located adjacent a main axis of the device, generally equidistant from the two scissor units.

3. A lifting device as claimed in claim 2, which includes a cover member extending between the base members of the two scissor units, wherein the combiner and divider valve means is located under the cover member.

4. A lifting device as claimed in claim 1, wherein the first and second scissor units include respective first and second ratchet mechanisms, for maintaining the support platforms in elevated positions.

5. A lifting device as claimed in claim 4, wherein for each scissor unit, the ratchet mechanism comprises an elongate bar, which is pivotally attached at one end to the other end of said other lever, and which includes a plurality of stops along the length thereof, and at least one abutment section secured to the respective base member, which abutment section can abut one of the stops, to limit travel of the scissor unit.

6. A lifting device as claimed in claim 5, which includes a release mechanism common to the first and second ratchet mechanisms.

7. A lifting device as claimed in claim 1, wherein the rear ends of the support platforms are bent downwards, to facilitate movement of vehicles onto and off the lifting device.

8. A lifting device as claimed in claim 7, wherein each support platform includes an approach ramp, which is rotatably attached to the rear end portion that is bent downwards.

9. A lifting device as claimed in claim 1, wherein the cross-brace, extends between the support platforms adjacent the rear thereof, to provide a forward working area between the support platforms that is unobstructed.

10. A lifting device as claimed in claim 1, wherein each support platform includes a recess at the front thereof for a turnplate, and front and rear location elements, to enable the support platforms to be located at a desired height for alignment work.

11. A lifting device as claimed in claim 1, wherein each scissor unit comprises: said base member; said support platform; a pair of first levers parallel to one another, and pivotally attached at one end to the base member; and a pair of second levers parallel to one another, pivotally attached at one end to the support platform and pivotally attached at their mid-points to mid-points of the first levers, with the other ends of the first levers being arranged for rotational and translational movement relative to the support platform and with the other ends of the second levers being arranged for rotational and translational movement relative to the base member.

12. A lifting device as claimed in claim 11, wherein for each scissor unit, the second levers are located within the first levers, and a common shaft pivotally connects the first and second levers.

13. In combination, a lifting device as claimed in claim 1, and a jack, which comprises a base element, a top element, a scissor mechanism between the base and top elements, at least one air piston and cylinder assembly for displacing the top element vertically relative to the base element, and horizontal and vertical rollers, for engaging sides of the support platforms, to enable the jack to be freely displaced along the length of the lifting device.

14. A combination as claimed in claim 12, wherein the jack includes four roller assemblies at corners thereof, with each roller assembly comprising one horizontal roller and one vertical roller.

15. A combination as claimed in claim 14, wherein the horizontal roller of each roller assembly is spring-loaded in a vertical direction, so that, when a sufficient vertical load is applied to the jack, the jack is depressed downwards to engage sides of the support platforms to limit further movement of the jack.

16. A combination as claimed in claim 14 or 15, wherein the inner edges of the support platforms are provided with channel-shaped members, on which the rollers run, and wherein the scissor mechanism of the jack extends trasversely with respect to the scissor units of the lifting device.

17. A combination as claimed in claim 13, which includes two vertical and parallel air piston and cylinder assemblies.

18. A combination as claimed in claim 17, wherein the scissor mechanism comprises a pair of first levers and a pair of second levers pivotally attached at mid-points thereof, and wherein one piston and cylinder assembly is pivotally attached to the first levers generally equidistant between said mid-point and one end thereof, and to the second levers generally equidistant between said mid-point and one end thereof, and the second piston and cylinder assembly is pivotally attached to the first levers generally equidistant between said mid-point and the other end thereof, and to the second levers generally equidistant between said mid-point and the other end thereof, thereby to give a displacement of the top element which is greater than the displacement of the pistons.

19. A combination as claimed in claim 18, wherein said one ends of the first levers are pivotally attached to the base element, said one ends of the second levers are pivotally attached to the top element, said other ends of the first levers are provided with rollers, which run in channels of the top elements, and the other ends of the second levers are provided with rollers which run in the channels of the base element.

20. A lifting device, for a vehicle, the lifting device comprising: first and second scissor units, each of which includes a base member, a support platform and a pair of levers which are pivotally interconnected adjacent their mid points, one of which levers is pivotally connected at one end to the base member, and the other of which levers is pivotally attached at one end to the respective support platform with the other ends of the levers being arranged for rotational and translational movement relative to the respective base member and support platform; for each scissor unit, a respective hydraulic piston and cylinder assembly pivotally attached to a lever of the respective scissor unit, for actuation thereof; a combiner and divider valve means for ensuring that the flows of hydraulic fluid to, or from, the hydraulic cylinders are substantially equal, irrespective of any pressure difference between the hydraulic piston and cylinder assemblies, said means including only an inlet for a supply of pressurized hydraulic fluid, and two outlets connected respectively to the two piston and cylinder assemblies and no fluid connection to any other component of the lifting device, only a single cross brace connected between the two support platforms, to assist in maintaining the support platforms level with one another; a cover member extending between the base members of the two scissor units, with the combiner and divider valve means located under the cover member, adjacent to main axis of the device, and generally equidistant from the two scissor units; a supply line leading to the combiner and divider valve means, and two branch lines extending from the outlets of the combiner and divider valve means to the two piston and cylinder assemblies, with a portion of the supply line and portions of the two branch lines located under the cover member, the two branch lines being of substantially equal length.

21. A lifting device, for a vehicle, the lifting device comprising: first and second scissor units, each of which includes a base member, a support platform and a pair of levers which are pivotally interconnected adjacent their mid-points, one of which levers is pivotally connected at one end to the base member, and the other of which levers is pivotally attached at one end to the respective support platform, with the other ends of the levers being arranged for rotational and translational movement relative to the respective base member and support platform; for each scissor unit, a respective hydraulic piston and cylinder assembly pivotally attached to a lever of the respective scissor unit, for actuation thereof; a combiner and divider valve means for ensuring that the flows of hydraulic fluid to, or from, the hydraulic cylinders are substantially equal, irrespective of any pressure difference between the hydraulic piston and cylinder assemblies, said means including only an inlet for a supply of pressurized hydraulic fluid, and two outlets connected respectively to the two piston and cylinder assemblies and no fluid connection to any other component of the lifting device; only a single cross brace extending between the two support platforms, to assist in maintaining the support platforms level with one another; respective first and second ratchet mechanisms for the first and second scissor units, each ratchet mechanism comprising an elongate bar, which is pivotally attached at one end to the other end of said other lever, and which includes a plurality of stops along the length thereof, and at lease one abutment section secured to the respective base member, which abutment section can abut one of the stops, to limit travel of the scissor unit; a cover member extending between the two base members, with the combiner and divider valve means located under the cover member generally equidistant from the two base members; a supply line extending partly under the cover member; first and second branch lines extending from the combiner and divider valve means under the cover member to the piston and cylinder assemblies; and a common release mechanism for the first and second ratchet mechanisms, which release mechanism comprises a rod extending through the base members and under the cover member, projections extending from the rod adjacent the bars of the ratchet mechanisms, and means for rotating the rod to cause the projections to lift the elongate bars clear of the abutment sections.

22. A lifting device as claimed in claim 1, 20, or 4 which includes respective first and second velocity fuses for the first and second scissor units, disposed between the combiner and divider valve means and the respective piston and cylinder assemblies, each of which velocity fuses closes off the respective cylinder, when the flow of hydraulic fluid therefrom exceeds a predetermined value.

23. A lifting device as claimed in claim 1, 20 or 4 which includes respective first and second velocity fuses, which are mounted on the hydraulic piston and cylinder assemblies of the first and second scissor units respectively, with the velocity fuses connected by flexible hoses to the base members and thence to the outlets of the combiner and divider valve means, each of which velocity fuses closes off the respective cylinder, when the flow of hydraulic fluid therefrom exceeds a predetermined value.

* * * * *